US012152323B1

(12) United States Patent
Head et al.

(10) Patent No.: US 12,152,323 B1
(45) **Date of Patent: *Nov. 26, 2024**

(54) THREE DIMENSIONAL BRAID

(71) Applicant: A&P Technology, Inc., Cincinnati, OH (US)

(72) Inventors: Andrew Head, Cincinnati, OH (US); Victor M. Ivers, Amelia, OH (US); Samuel P. Ivers, Amelia, OH (US)

(73) Assignee: A&P TECHNOLOGY, INC., Cincinnati, OH (US)

( * ) Notice: Subject to any disclaimer, the term of this patent is extended or adjusted under 35 U.S.C. 154(b) by 189 days.

This patent is subject to a terminal disclaimer.

(21) Appl. No.: 17/548,475

(22) Filed: Dec. 10, 2021

Related U.S. Application Data

(63) Continuation-in-part of application No. 16/929,007, filed on Jul. 14, 2020, now abandoned, which is a continuation of application No. 15/643,932, filed on Jul. 7, 2017, now abandoned, which is a continuation of application No. 14/210,874, filed on Mar. 14, 2014, now Pat. No. 9,702,069.

(60) Provisional application No. 61/788,944, filed on Mar. 15, 2013.

(51) Int. Cl.

| | |
|---|---|
| ***D04C 1/06*** | (2006.01) |
| ***D03D 11/00*** | (2006.01) |
| ***D04C 3/38*** | (2006.01) |
| ***D04C 3/40*** | (2006.01) |
| *D04C 1/04* | (2006.01) |

(52) U.S. Cl.
CPC ..... *D04C 1/06* (2013.01); *D03D 11/00* (2013.01); *D04C 3/38* (2013.01); *D04C 3/40* (2013.01); *D04C 1/04* (2013.01)

(58) Field of Classification Search
CPC ... D04C 1/04; D04C 1/06; D04C 3/38; D04C 3/40; D03D 11/00
See application file for complete search history.

(56) References Cited

U.S. PATENT DOCUMENTS

| | | | | |
|---|---|---|---|---|
| 1,999,578 A * | 4/1935 | Sidebotham | D03D 1/0094 | 139/384 R |
| 2,681,667 A * | 6/1954 | Slaughter | D03D 11/00 | 139/411 |
| 3,053,287 A * | 9/1962 | Williams | D03D 11/00 | 139/385.5 |
| 3,463,202 A * | 8/1969 | Brand | F16F 7/006 | 139/408 |

(Continued)

*Primary Examiner* — Shaun R Hurley
(74) *Attorney, Agent, or Firm* — FisherBroyles, LLP; Jeremy P. Sanders

(57) ABSTRACT

A three-dimensional braid includes a plurality of first plaits adjacent one another oriented in a first direction and a plurality of second plaits adjacent one another oriented in a transverse second direction intertwined forming a braid with each first plait intersecting each of the plurality of second plaits in succession. Each first plait includes a first group of tows and a second group of tows, each of the tows in the first group of tows corresponding to one of the tows in the second group of tows in pairs of first plait tows. Each second plait includes a plurality of tows. For each first plait, one of the first plait pairs crosses over a subset of second plait tows at each intersection of the first plait and successive second plaits forming a series of braid points along the first plait.

5 Claims, 14 Drawing Sheets

(56) References Cited

U.S. PATENT DOCUMENTS

| | | | | |
|---|---|---|---|---|
| 3,464,459 | A * | 9/1969 | Ballard | D03D 11/00 139/415 |
| 3,612,110 | A * | 10/1971 | Wildi | D03D 11/00 139/408 |
| 4,004,616 | A * | 1/1977 | Andronov | D03D 1/0005 139/426 R |
| 6,495,227 | B1 * | 12/2002 | Cahuzac | B29C 70/22 138/123 |
| 9,003,757 | B2 * | 4/2015 | Mozsgai | D07B 1/18 57/201 |
| 9,702,069 | B2 * | 7/2017 | Head | D03D 11/00 |
| 2003/0211797 | A1 * | 11/2003 | Hill | H05K 1/038 442/205 |
| 2004/0012937 | A1 * | 1/2004 | DeGrappo | H05K 1/16 361/782 |
| 2010/0208445 | A1 * | 8/2010 | Asvadi | D03D 11/00 442/206 |
| 2011/0175630 | A1 * | 7/2011 | Bhattacharya | H05K 1/189 361/329 |
| 2012/0040579 | A1 * | 2/2012 | Russell | D03D 15/56 442/184 |
| 2013/0040081 | A1 * | 2/2013 | Yoshimura | D03D 11/02 28/165 |

* cited by examiner

THREE DIMENSIONAL BRAID

RELATED APPLICATIONS

This application is a continuation-in-part of U.S. patent application Ser. No. 16/929,007, filed Jul. 14, 2020, which is a continuation of U.S. patent application Ser. No. 15/643,932, filed Jul. 7, 2017, which is a continuation of U.S. patent application Ser. No. 14/210,874, filed Mar. 14, 2014, now U.S. Pat. No. 9,702,069, which claims the benefit of U.S. Provisional Application No. 61/788,944, filed Mar. 15, 2013, each of which are hereby incorporated herein by reference.

BACKGROUND

Various prior fabrics and braided materials have been used in the manufacture of composite articles. For example, two-dimensional fabrics, whether braided, woven, or made by non-woven processes, are typically deployed in the manufacture of a composite part in multiple layers of material to build up predetermined thicknesses of material that may vary throughout the composite part. Prior conventional three-dimensional fabrics have been similarly used in the manufacture of composite parts. With two-dimensional fabrics without further processing, there are no tows that convey in-thickness loads from one layer of material to the next, i.e., there is no means of transmitting load transverse to the layers of fabric material except through the resin encasing the fabric, which by itself typically has limited ability to support the loading. Some measure of intertwining between the layers can be imparted into the structure by stitching or sewing additional materials through the layers. This intermediate or post-processing type of operation results in a pseudo three-dimensional structure providing some measure of cross-thickness load transfer, however, the known intermediate or post processing operations provide limited structure between the layers, and includes materials that are distinct from the in-thickness materials. The resulting load transfer typically remains through the resin encasing the fabric materials.

In this disclosure we use the term "tow" as a cluster or grouping of materials that extend together in a principal direction as a unit. Tows may be one fiber or a plurality of fibers. Tows may include monofilaments, multiple filaments or combinations of monofilament and multiple filament strands, and may be staple or spun materials. Tow materials can have a variety of cross-sectional shapes, including but not limited to, generally circular, ellipsoidal, triangular and flat tape shapes. Fibers forming a tow may be twisted, twined, braided or otherwise shaped or combined, or may extend contiguously without being twisted or twined together. Fibers forming tows may be coated with resin or other coating to facilitate braiding and/or subsequent processing. A tow can include any combination of materials and material forms. As examples, a tow may include all carbon materials, a combination of carbon and thermoplastic materials, or a combination of aramid and glass materials. Other combinations of tow materials are known and used in composite structures and may be used in the present invention.

Prior three-dimensional structures have tows providing cross-thickness load paths, which is in the radial direction in a tubular sleeve. Three prior methods of forming three-dimensional braids include (1) the 4-step process, (2) the two-step process, and (3) the multilayer interlock braiding process. The 4-step process is also known by other names such as row-and-column braiding, Omniweave, Magnaweave, and through-the-thickness braiding. The 4-step braiding machine has a flat or cylindrical bed moving tow carriers from predetermined point-to-point locations on a grid of rows and columns. In a first step, a group of tow carriers is moved within columns in directions that alternate column to column, a second step includes moving another group of tow carriers within rows in directions that alternate row to row. In third and fourth steps, these operations are carried out in reverse with or without involving the same groups of tow carriers. The four steps are repeated to form a braid, and the groups of tow carriers may change from one repetition to another. In various alternatives, additional tow carriers are added around the outside perimeter of the shape formed by the moving carriers. A mechanism is typically required in 4-step braiding to compact the tows into the braided form during the process to consolidate the braided structure as it is being formed. The 4-step process is exemplified by U.S. Pat. No. 4,312,261 Florentine.

The two-step three-dimensional braiding process includes a relatively large number of fixed tow carriers that deliver tows into an axial direction of the braided structure and a fewer number of moving tow carriers as compared to 4-step braiding. The two steps include first moving some group of tow carriers in alternate directions column to column, and second, moving another group tow carriers in alternate directions row to row. Unlike 4-step braiding, no mechanical means of compacting the tows into the braided form is typically required because the yarn tension serves this purpose. The two-step process is exemplified by U.S. Pat. No. 4,719,837 McConnell et al.

The multilayer interlocking three-dimensional braiding process uses a braiding machine that moves tow carriers in a way similar in configuration to a circular braiding machine used to manufacture conventional two-dimensional braids. However, in the multilayer interlocking process, rows of tow carrier conveyance devices, the most common being what are referred to as "horn gears" are arranged in a Cartesian grid or in concentric circular paths around the longitudinal axis of the braiding machine. Then, the tow carriers move from one row to an adjacent row in a predetermined pattern. The multilayer interlocking process is exemplified by U.S. Pat. No. 5,388,498 Dent et al and U.S. Pat. No. 5,501,133 Brookstein et al.

Prior multilayer interlocked braids tend to provide intertwined tows primarily in the plane of the braid structure similar to the way tows are in a conventional two-dimensional braid structure. This typically results in better in-plane properties of the braided structure than 4-step and two-step braids, but less radial or cross-thickness strength. The 4-step and two-step braids typically allow for a greater density of tows in the braided structure and produce a greater degree of intertwining in the radial or cross-thickness principal directions, but typically provide less in-plane strength.

SUMMARY

Disclosed is a braided material having a plurality of first plaits adjacent one another oriented in a first direction having a positive angle from a reference braid direction; and a plurality of second plaits adjacent one another oriented in a second direction transverse to the first direction having a negative angle from the reference braid direction, where the plurality of first plaits are intertwined with the plurality of second plaits forming a braid. Each first plait includes a first group of tows having X number of tows and a second group of tows having X number of tows, each of the tows in the first group of tows corresponding to one of the tows in the second group of tows in X number of pairs of first plait tows. Each second plait includes a third group of tows having Y number of tows and a fourth group of tows having Y number of tows, each of the tows in the third group of tows corresponding to one of the tows in the fourth group of tows in Y number of pairs of second plait tows. Each first plait intersects each of the plurality of second plaits in succession, and for each first plait, one of the first plait pairs crossing over a subset of second plait tows at each intersection of said first plait and successive second plaits forming a series of X braid points along the first plait.

Each second plait intersects each of the plurality of first plaits in succession, and for each second plait, one of the second plait pairs crossing over a subset of first plait tows at each intersection of said first plait and the successive first plait forming a series of Y braid points along the second plait.

BRIEF DESCRIPTION OF THE DRAWINGS

A better understanding of the features, advantages and principles of the present disclosure will be obtained by reference to the following detailed description that sets forth illustrative embodiments, and the accompanying drawings of which.

DETAILED DESCRIPTION

The following detailed description and provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

Disclosed is a three-dimensional braided structure wherein the intertwining in the radial or cross-thickness direction is achieved at the same time as the intertwining in the other principal directions.

Figure 1:
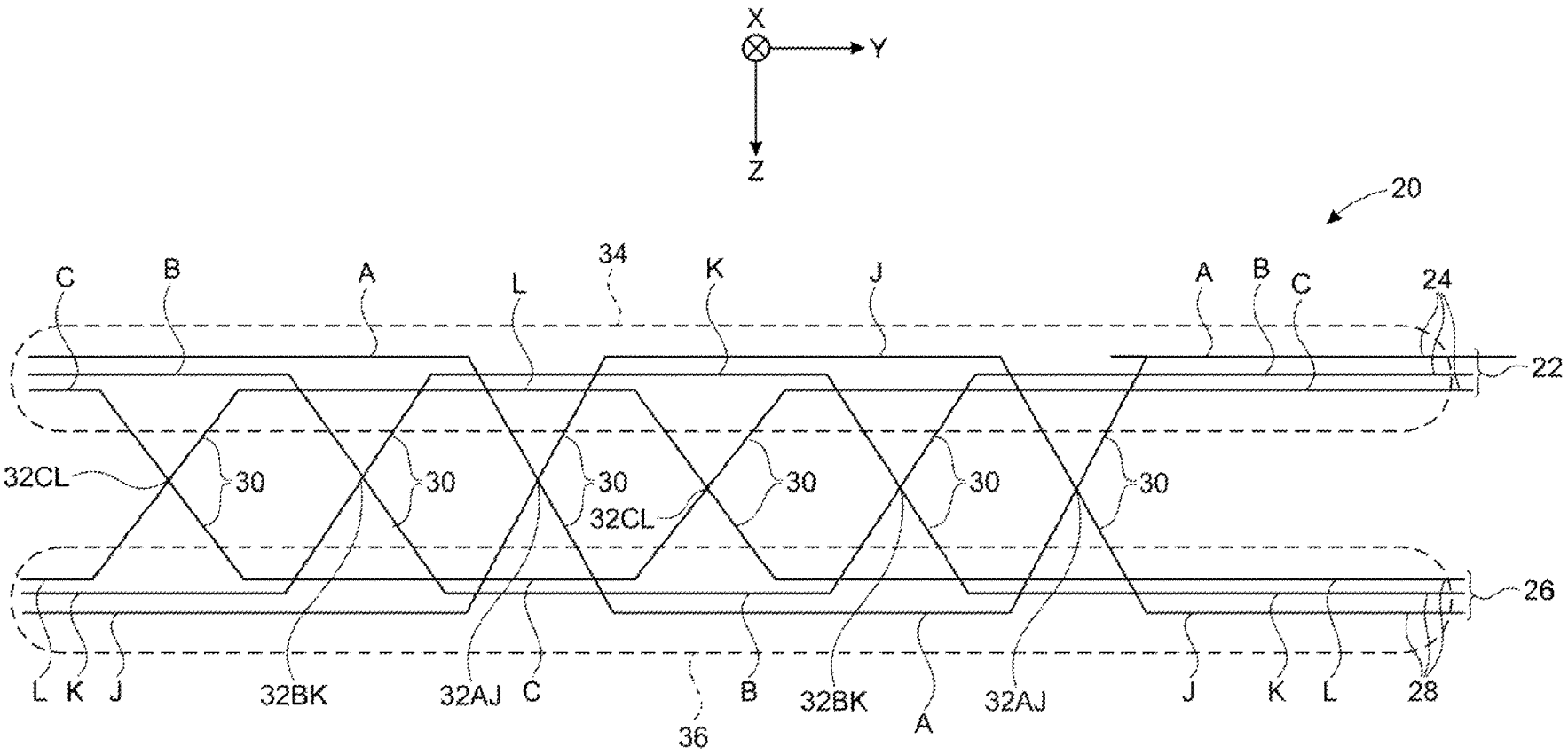
FIG. 1 is a diagrammatical representation of a portion of a tow ladder substructure from a braid, in accordance with some embodiments.
Figure 2:
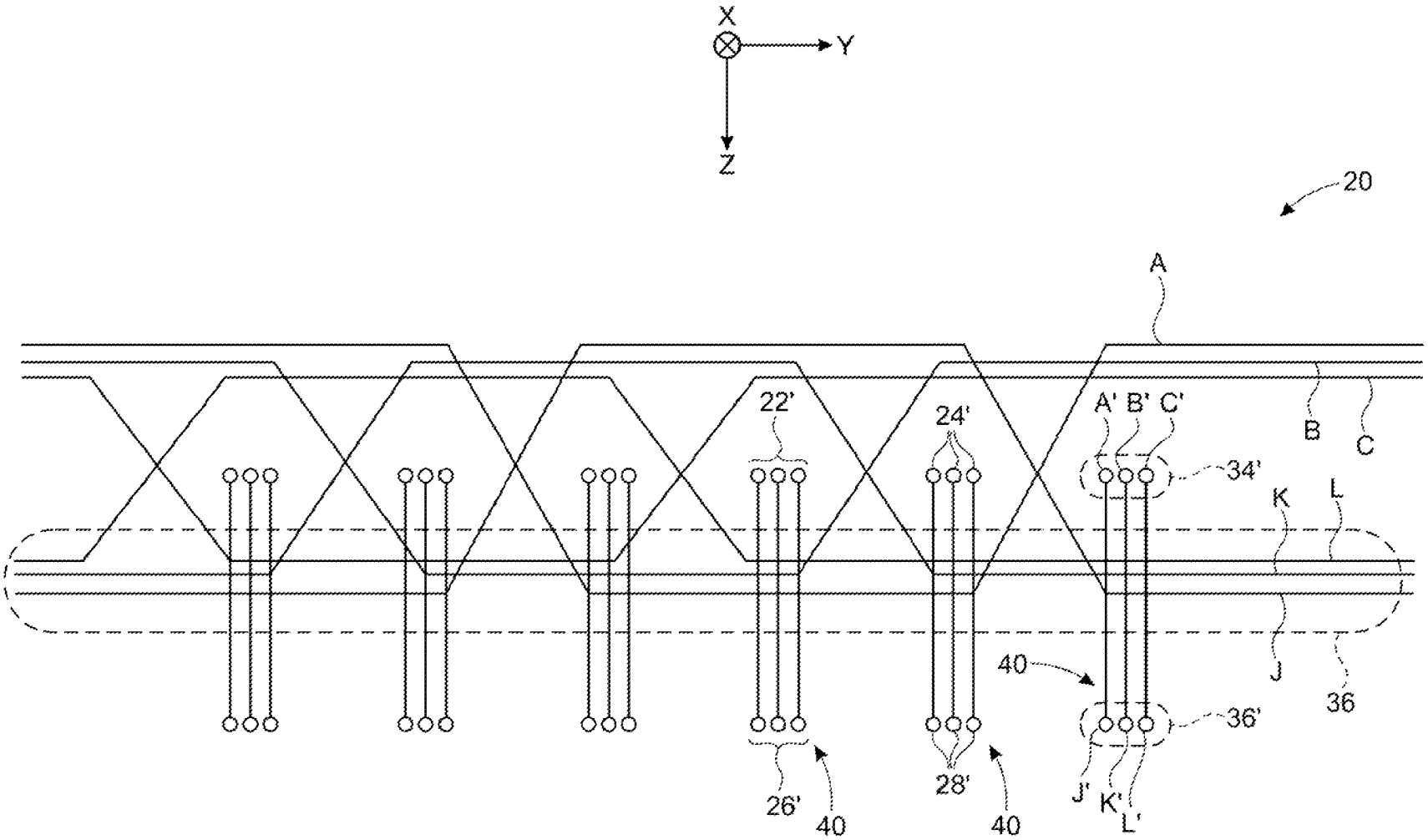
FIG. 2 is a diagrammatical representation of the tow ladder substructure of FIG. 1 showing intersecting transverse tow ladder substructures, in accordance with some embodiments.
Figure 3:
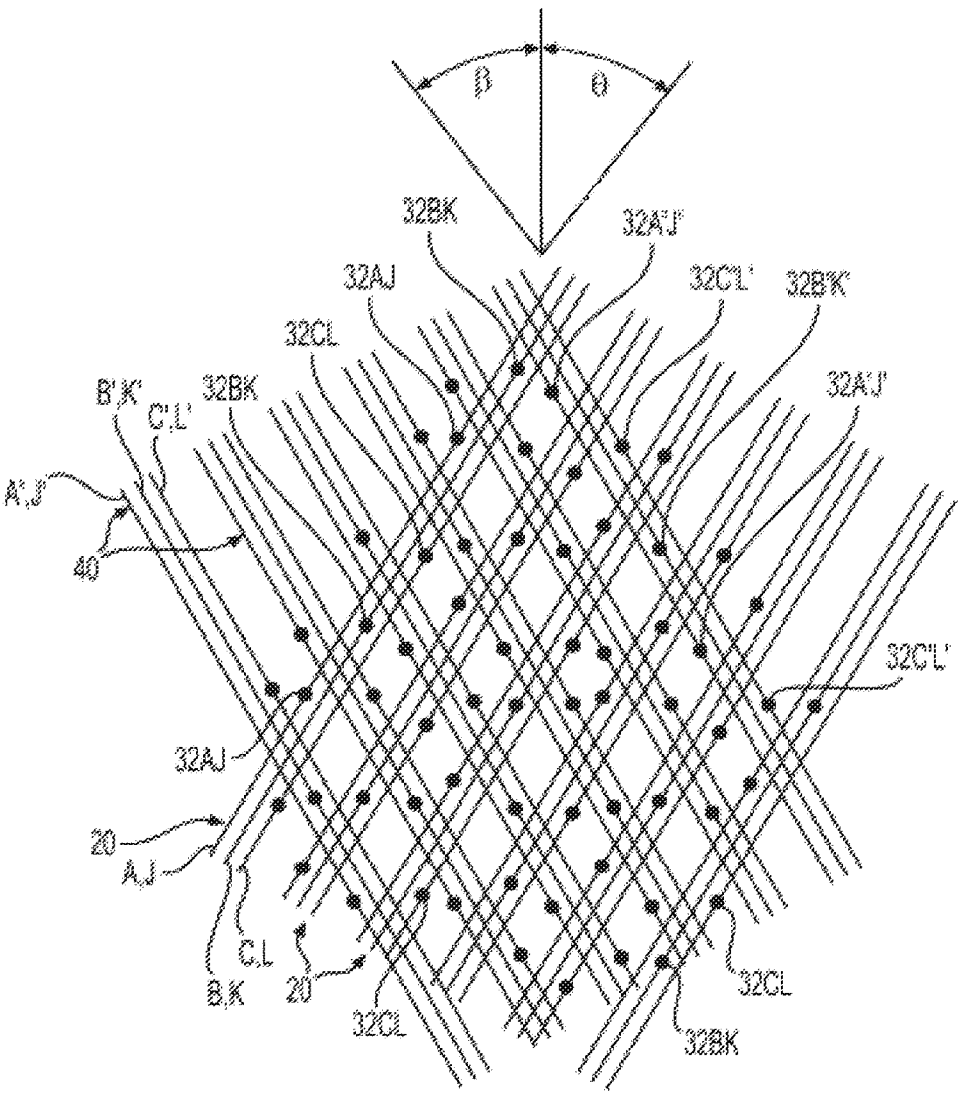
FIG. 3 is a diagrammatical representation of a three-dimensional braid of the present disclosure showing location of braid points in the braid, in accordance with some embodiments.

For explanatory purposes, the present braid structure can be conceptually described as replacing the tows in the bi-axial or oblique directions of a conventional two-dimensional braid structure with sub-structural elements made up of groups of tows forming a pattern within the sub-structural elements resembling a ladder whose rails lie along the principal direction of the conventional two-dimensional tow and whose rungs lie along the radial direction. These sub-structural elements will be referred to as tow ladder substructures or plaits. In one alternative embodiment, the braided sleeve may be slit to form a braided fabric, as shown in FIG. 3 and described further below. As described herein, the radial direction of the braided sleeve is equivalent to the cross-thickness direction of the braided fabric. The radial direction also is perpendicular to central axis, which is parallel to Y axis in a three-dimensional coordinate system, and the reference braid direction of the braided sleeve. The braided fabric is described herein as having a length and a reference braid direction, as shown in FIGS. 1 and 2 et al. Similarly to the radial direction in the braided sleeve, the cross-thickness direction is perpendicular to the reference braid direction in the braided fabric. Further, as described herein, the rungs of the ladder may lie along the radial direction, which may be equivalent to the Z axis in a three-dimensional coordinate system. Additionally, each rung, as described in embodiments of the foregoing discussion, may be formed by the crossing of tow materials between inner and outer portions of the braided structure, such that each crossing, or rung, may be comprised between rails of each tow ladder substructure. The distance along the cross-thickness direction between inner and outer portions is shown in FIGS. 1 and 2 et al. and may be referred to as a length or width along or of the cross-thickness direction.

The present three-dimensional braid can be generally viewed as a first plurality of generally parallel tow ladder substructures, or plaits, lying adjacent one another oriented in a first principal oblique direction having a positive angle θ from a reference braid direction, and intertwined with a second plurality of generally parallel tow ladder substructures, or plaits, lying adjacent one another oriented in a second opposing principal oblique direction transverse to the first direction having a negative angle B from the reference braid direction. The plurality of first plaits are intertwined with the plurality of second plaits forming the braid.

The tow ladder substructure, or plait, includes two groups of tows where each of the tows in one of the groups corresponding to one of the tows in the other group so that the tow ladder substructure is arranged in a desired number of pairs of tows. For example, a first plait may include a first group of tows having X number of tows and a second group of tows having X number of tows, where each of the tows in the first group of tows corresponds to one of the tows in the second group of tows in X number of pairs of first plait tows. Additionally, along the plait, a portion of the tows in the tow ladder substructure forms an outer subset and the remainder of the tows of the plait forms an inner subset, and each of the pairs of tows in the tow ladder substructure has one tow in the inner subset and one tow in the outer subset. In the present specification and claims, inner and outer refer generally to position relative to the central longitudinal axis of the braid structure when in a tubular form.

In forming the braid, each tow ladder substructure in the first principle oblique direction intertwines with the plurality of tow ladder substructures, or plaits, that are oriented in the transverse principal oblique direction by crossing one of its pairs of tows at each subsequent intersecting plait. Stated another way, at each intersection between a plait in the first direction and a transverse plait, one of the plait pairs in the first direction crosses over a subset of tows in the transverse plait so that the tow of the crossing pair in the inner subset switches to the outer subset and the other tow of the pair switches to the inner subset. One of the pairs of tows crosses at each subsequent intersection with a transverse tow ladder substructure until all of the plait pairs have crossed, and then the crossing sequence repeats. In this example, the plait pairs of the tow ladder substructure in the first direction cross over the outer subset of tows in each of the transverse plaits in the second direction.

At the same time, each tow ladder in the second direction intertwines with the plurality of tow ladder substructures, or plaits, in the transverse first principle direction by crossing one of its pairs of tows at each subsequent intersecting plait. At each intersection between a plait in the second direction and a transverse plait, one of the plait pairs in the second direction crosses over a subset of tows in the transverse plait so that the tow of the crossing pair in the inner subset switches to the outer subset and the other tow of the pair switches to the inner subset. One of the pairs of tows crosses at each subsequent intersection with a transverse tow ladder substructure until all of the plait pairs have crossed, and then the crossing sequence repeats. In this example, the plait pairs of the tow ladder substructure in the second direction cross over the inner subset of tows in each of the transverse plaits in the first direction.

Referring now to FIG. 1, a diagrammatic representation of one plait 20 or tow ladder substructure is shown having a first group of tows 22, traveling along the Y axis, having X number of tows 24 and a second group of tows 26, traveling along the Y axis, having X number of tows 28, where each of the tows 24 in the first group of tows corresponds to one of the tows 28 in the second group of tows in X number of pairs 30 of first plait tows. For illustration, X is three for the example of FIG. 1, and the tows 24 are identified as tows A, B, and C. Similarly, the tows 28 are identified as tows J, K, and L. The pairs 30 of first plait tows include tows A and J, B and K, and C and L. The ladder-type structure is formed as the pairs cross forming braid points 32 along the plait, with tows A and J, B and K, and C and L traveling in the Z direction. Each braid point 32, or pair crossing forms a "rung" of the ladder structure. As discussed above, along the plait 20 a portion of the tows in the tow ladder substructure forms an outer subset 34 and the remainder of the tows of the plait forms an inner subset 36. Each of the pairs 30 of tows in the tow ladder substructure 20 has one tow in the inner subset 36 and one tow in the outer subset 34, and the make-up of the inner and outer subsets change as the pairs 30 cross at the braiding points 32.

As shown by a diagrammatic representation in FIG. 2, the plait 20 or tow ladder substructure in a first direction intersects a plurality of transverse plaits 40 in a transverse second direction. In the embodiment shown in FIG. 2, the transverse plaits 40 have the same tow ladder substructure as described for plait 20 with respect to FIG. 1. In this way, transverse plaits 40 include a group of tows 24' identified in FIG. 2 as tows A', B', and C', traveling along the X axis. Similarly, the transverse plait 40 includes another group of tows 28' identified as tows J', K', and L', traveling along the X axis. Additionally as discussed herein, along the plait 40 a portion of the tows in the tow ladder substructure forms an outer subset 34' and the remainder of the tows of the plait forms an inner subset 36'. In the embodiment shown in FIG. 2, the tows 22' and 26' travel along the X axis. The pairs crossing in the first plait 20, comprising tows A-C and J-L, as discussed above with respect to FIG. 1 each cross over a subset of tows of a transverse plait 40, comprising tows A'-C' and J'-L', in the second direction as shown diagrammatically in FIG. 2. More specifically, the pairs crossing in the first plait 20 cross over the outer subset of the transverse plait 40.

Each plait 40 in the second direction also crosses its pairs at the intersection of transverse plaits 20 in the first direction. As can be seen from FIG. 2, pair crossings of plait 40 will be crossing over the inner subset of the plait 20.

Figure 2A:
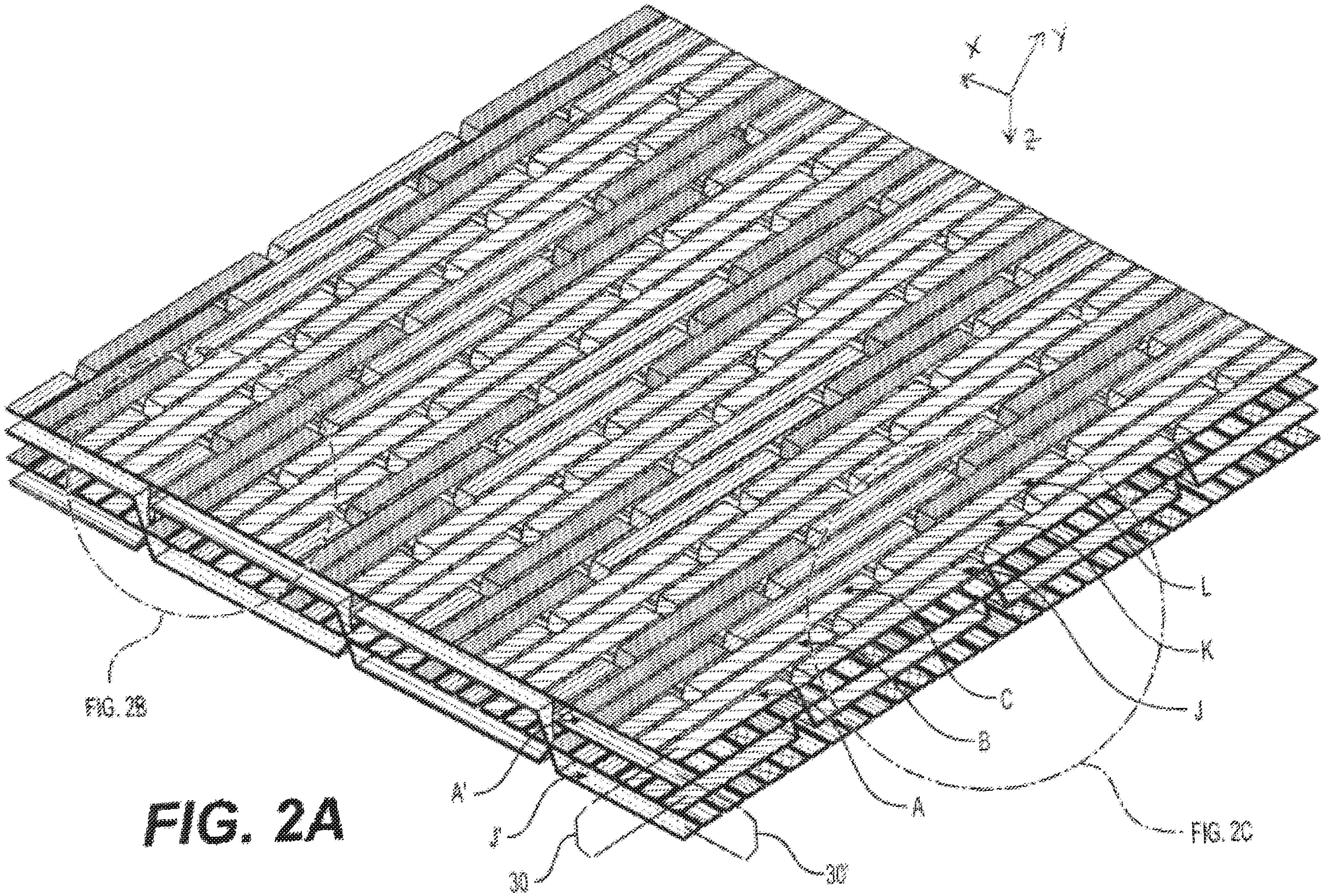
FIG. 2A is a diagrammatical representation of a plurality of tow ladder substructures of FIG. 2 which three dimensionally illustrates the intertwining of tow ladder substructures, in accordance with some embodiments.

FIG. 2A illustrates a three-dimensional view of FIG. 2 in which a plurality of first plaits 20, comprising tows A-C and J-L, traveling in a first direction, ø oblique to the reference braid direction, intersect a plurality of transverse plaits 40, comprising tows A'-C' and J'-L', traveling in a second direction, β oblique to the reference braid direction. Further FIG. 2A illustrates tow pairs, 30 and 30' which comprise the tow ladder substructures traveling in the ø and β directions at the crossings.

Figure 2B:
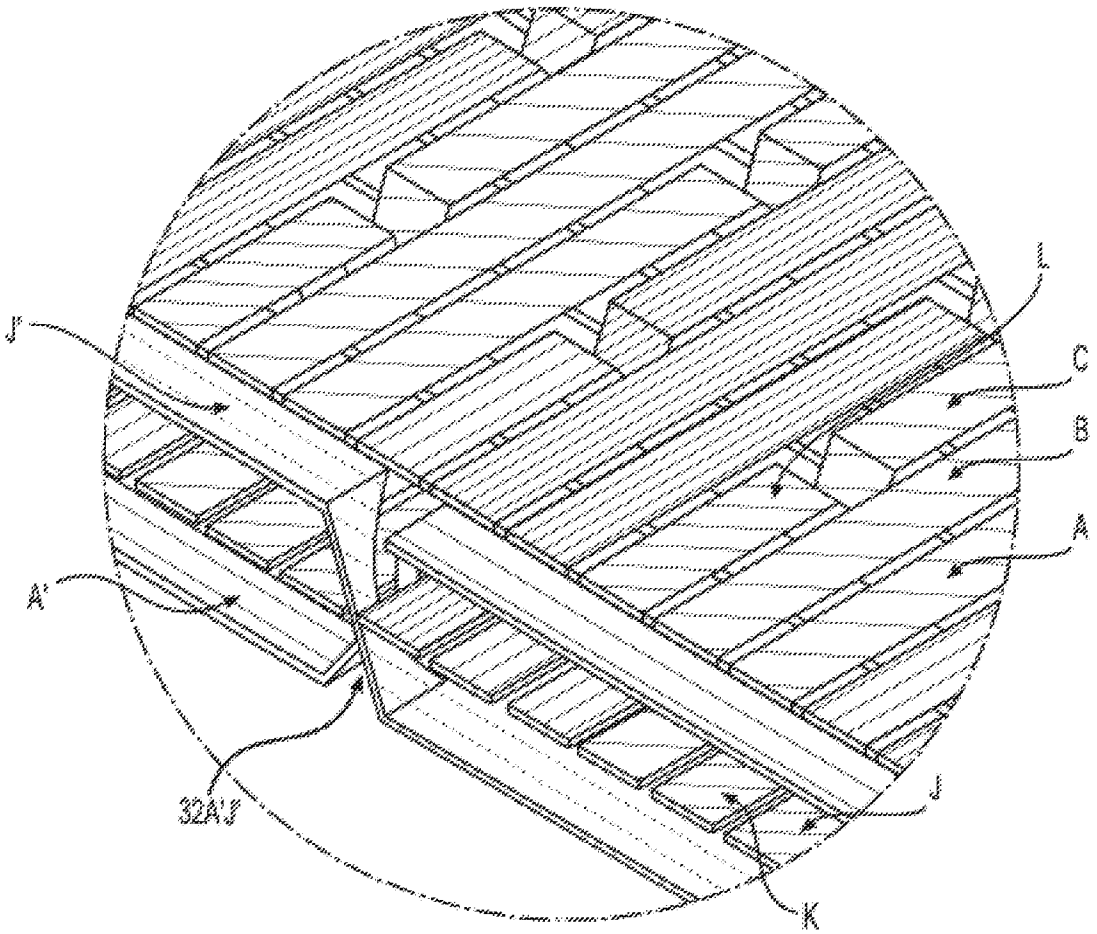
FIG. 2B is a sectional view of FIG. 2A which illustrates in additional detail the intertwining of the tow ladder substructures of FIG. 2, in accordance with some embodiments.
Figure 2C:
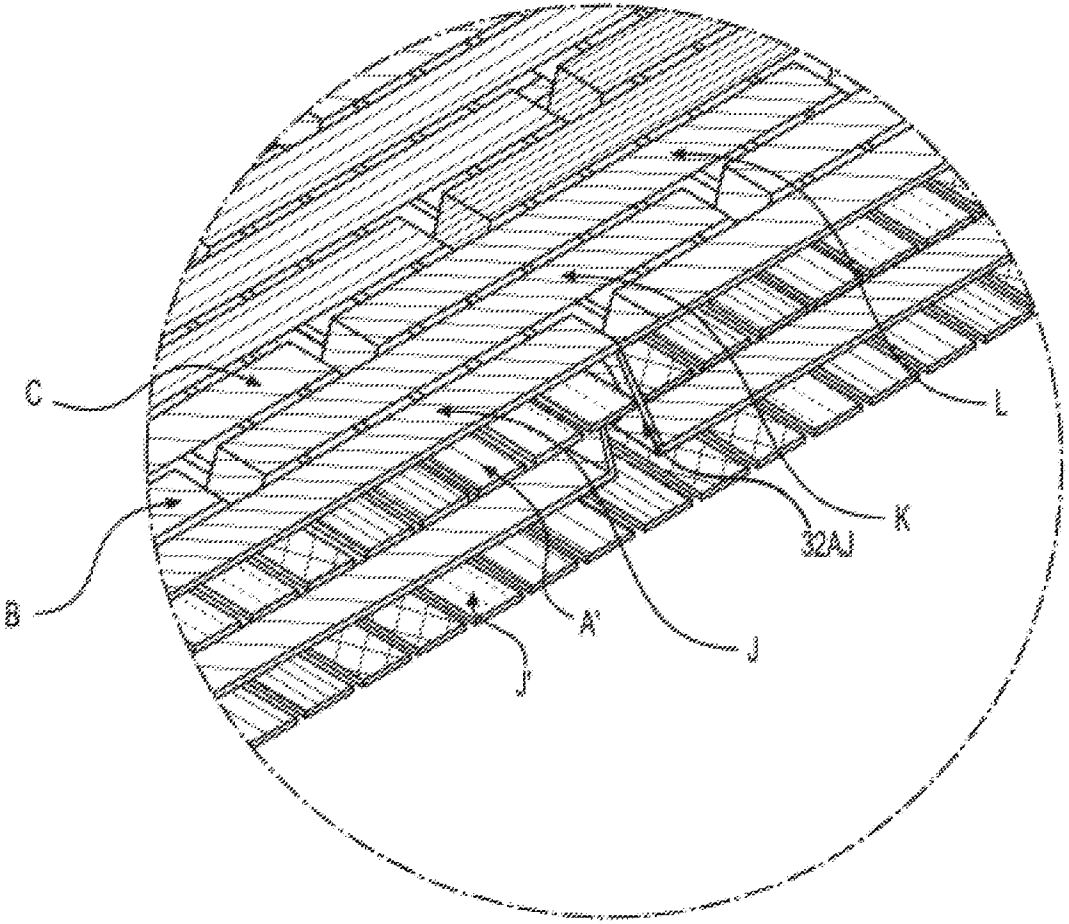
FIG. 2C is an additional sectional view of FIG. 2A which further illustrates the intertwining of the tow ladder substructures of FIG. 2, in accordance with some embodiments.

FIGS. 2B and 2C illustrate specific sectional views of FIG. 2A. FIG. 2B illustrates the exchange of tows A' and J' between inner 36' and outer 34' subsets of the braided structure as well as tow pairs 30 A and J, B and K and C and L comprising the braided structure of FIG. 2A. FIG. 2C is illustrative of the exchange of tows comprising tow pairs 30 B and K and C and L between inner 36 and outer 34 subsets of the braided structure as well as tow pair 30' A' and J' and tow J comprising the braided structure of FIG. 2A. FIG. 2A depicts the interchange of tows A-C and J-L comprising the plurality of first plaits 20 on the surface of the braided structure while the transverse plaits 40, comprising tows A'-C' and J'-L' are located in subsequent layers of the braided structure.

In some embodiments, such as the embodiments shown in FIGS. 1 and 2, 2A, 2B and 2C, the tows in the first direction plait 20, comprising tows A-C and J-L, and the second direction plait 40, comprising tows A'-C' and J'-L', follow a path that passes over three transverse tow ladder substructures before crossing, exchanging tows from inner and outer subsets to run along the opposing tow ladder substructure rail. More generally, each tow passes over X number of transverse tow ladder substructures before crossing, exchanging inner and outer tow subsets to run along the opposing tow ladder substructure rail, where X is the number of pairs in the plait.

Figure 4:
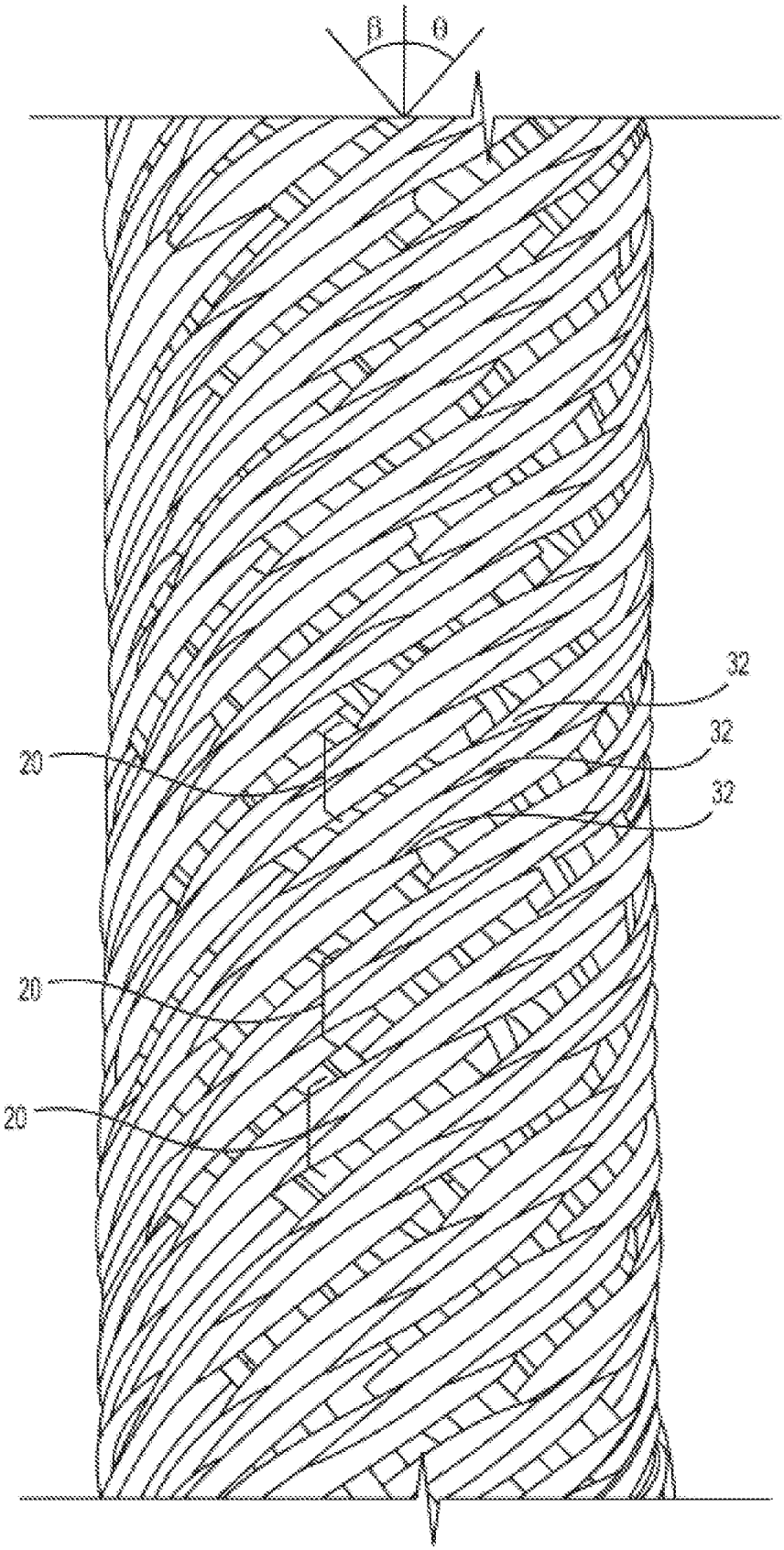
FIG. 4 is a side view showing a length of the present three-dimensional braid, in accordance with some embodiments.

Referring now to FIGS. 2, 2A, 2B, 2C and 3, the present three-dimensional braid is generally viewed as a first plurality of generally parallel first plaits 20 lying adjacent one another oriented in the first principal oblique direction having a positive angle θ, illustrated in FIG. 3, from a reference braid direction, and intertwined with a second plurality of generally parallel plaits 40 lying adjacent one another oriented in a second opposing principal oblique direction transverse to the first direction having a negative angle B from the reference braid direction. The plurality of first plaits 20, comprising tows A-C and J-L, are intertwined with the plurality of second plaits 40, comprising tows A'-C' and J'-L', as discussed above forming the braid. For each plait, as the tows pass over a transverse plait one of the pairs of the plait will cross forming a braid point 32 and exchanging the tows from the inner and outer subsets. The braid is further shown in FIG. 4.

In braid structures crimping refers to change in tow orientation where a tow passes through the general plain of a braid structure to pass beneath or over opposing tows. In a repeating braid pattern, essentially equivalent changes in tow orientation occur in each of the similarly-oriented tows adjacent one another in the same oblique direction. Those crimps corresponding to the same change in tow orientation in adjacent tows are called "like-crimps." In conventional two-dimensional braid structures, like-crimps in tows extending along the same oblique direction advance by one set of transverse intersecting tows from one adjacent tow to the next. The direction of tows in a braid is generally selected to correspond to direction of forces in a desired applications. Lines of like-crimps across a braid can affect how the braid distributes loads through the structure. Therefore, the orientation of lines of like-crimp is typically predetermined depending upon the characteristics of the tow materials and material forms, the as-braided and the in-structure fiber directions, the rate of braid pull-off relative to tow supply rate, and the diameter of the tubular braid structure, and other factors. The spacing of lines of like-crimp is affected by the selection of braid structure.

In some exemplary embodiments, such as shown in FIGS. 2-3, for tow ladder substructures adjacent one another in the same direction, the same tow pairs, or like-crimps, do not cross at the same transverse plait, instead the equivalent pair, or like-crimps in an adjacent tow ladder substructures crossing on the next or the preceding transverse plait, forming lines of like-crimps across the braid analogous to lines of like-crimps that are developed in two-dimensional braids. Alternatively, instead of like-crimps crossing on the next or preceding transverse plait, in certain embodiments the like crimps cross on a desired multiple of transverse plaits forward or preceding, such as the second, or the third transverse plaits forward or preceding.

In the present three-dimensional braid structure, each tow pair crossing forming a braid point is a crimp point. At each crimp point, one of the tows in a pair in one oblique direction changes orientation while the other tow of the pair in the same direction makes the opposite change crossing at a braid point in the structure as discussed above. All of the braid points form like-crimp points with mutually opposing changes in load path at each point. Additionally, in the present three-dimensional braid, at each crimp point only one of the plait pairs cross and the tows of the non-crossing pairs pass by the crimp further strengthening the braid point. As such, and the present three-dimensional braid structure offers more consistency of crimp throughout the braid structure than prior three-dimensional braids. The crimp pattern in the present three-dimensional braid is expected to yield improved properties as compared to similarly measured properties in conventional two- and three-dimensional braids.

Additionally, the linear crimp density of tows in conventional two- and three-dimensional braid structures is relatively high in comparison with the present three-dimensional braid. For example, a regular two-dimensional braid with 3 millimeter wide tows may have a linear crimp density of 0.167 crimps/millimeter, or 167 crimps/meter. 4-step and two-step three-dimensional braids can have similar linear crimp densities, with the added disadvantage that crimps on any one tow are oriented in multiple directions. In contrast, the tows in the present three-dimensional braid, particularly of the exemplary embodiments having the same tow width, have a crimp density of 111 crimps/meter and the crimps on any one tow generally may all lie in the same plane.

In various applications, each first plait 20 may include X number of tows in the first group 22 and at least X number of tows in the second group 26, where each of the tows in the first group 22 of tows corresponds to one of the tows in the second group of tows 26 in X number of pairs 30 as discussed above. Similarly, each second plait 40 may include Y number of tows in a third group 22' and at least Y number of tows in a fourth group 26', where each of the tows in the third group 22' of tows corresponds to one of the tows in the fourth group of tows 26' in Y number of pairs 30'. In the example represented in FIGS. 1-3, X=3 and Y=3. However, it is contemplated that the number of tows in the plaits may be varied as desired for an application. For example, the plaits in the first direction may have X=3 while the plaits in the second direction have Y=2. Alternatively, X is selected from a range from 2 to 6 and Y is selected from a range from 2 to 6. Various combinations are contemplated, including X=4 and Y=4; X=3 and Y=4; X=2 and Y=2; X=3 and Y=2; and X=4 and Y=2; and other configurations as desired.

A fabric formed with X=3 and Y=3 as described as an exemplary embodiment may be viewed as resembling two layers of conventional regular braid. However, the mechanical and thermal responses of the present three-dimensional braid are significantly improved due to the contiguous radial intertwining and the unique tow ladder substructure of the present braid.

In certain embodiments, the number of tows in the first (or third) group may be different than the number of tows in the second (or fourth) group leaving an unpaired tow. For example, while the first group has 3 tows, the second group may have 4 tows, which provides 3 pairs and 1 unpaired tow. The unpaired tow may be coupled with one of the second group tows when crossing pairs, or may cross between the inner and outer subsets at any desired interval, sequence or pattern independently.

Axial tows may be provided in the braid in a manner similar to a two-dimensional braid. Axial tows may be laid-in along the longitudinal direction as the first plaits and second plaits are braided. Alternatively or additionally, the tows in the longitudinal direction may be intertwined. The axial tows may intersect and/or intertwine with the first plaits 20 or the second plaits 40, or a combination thereof.

The first direction angle 8 and the second direction angle form the two opposing oblique principal directions and a longitudinal principal direction. In various embodiments, ∘=45° and =−45°, represented by +45∘/−45°, or +45/−45. When axial tows are provided along the longitudinal direction, the braid angles are represented by +45∘/0∘/−45°, or −45/0/45. In some exemplary embodiments, such as those shown in the figures, the braid angles may be +60∘/−60∘ or +60∘/0∘/−60°. Alternate embodiments can be made with different geometric orientation of the principal directions of the braid structure, such as +60/0/−45 geometries. Other braid angles may be used as desired for the requirements of the application. Alternate embodiments include those with and without tows laid-in the longitudinal direction of the braid structure.

In one alternative, the present three-dimensional braid includes additional layers of structure. In one example, a dual layer braid structure incorporates a third set of tow ladder substructures in the second direction such that the first plaits in the first direction are between the second plaits and third plaits in the second direction.

Figure 5:
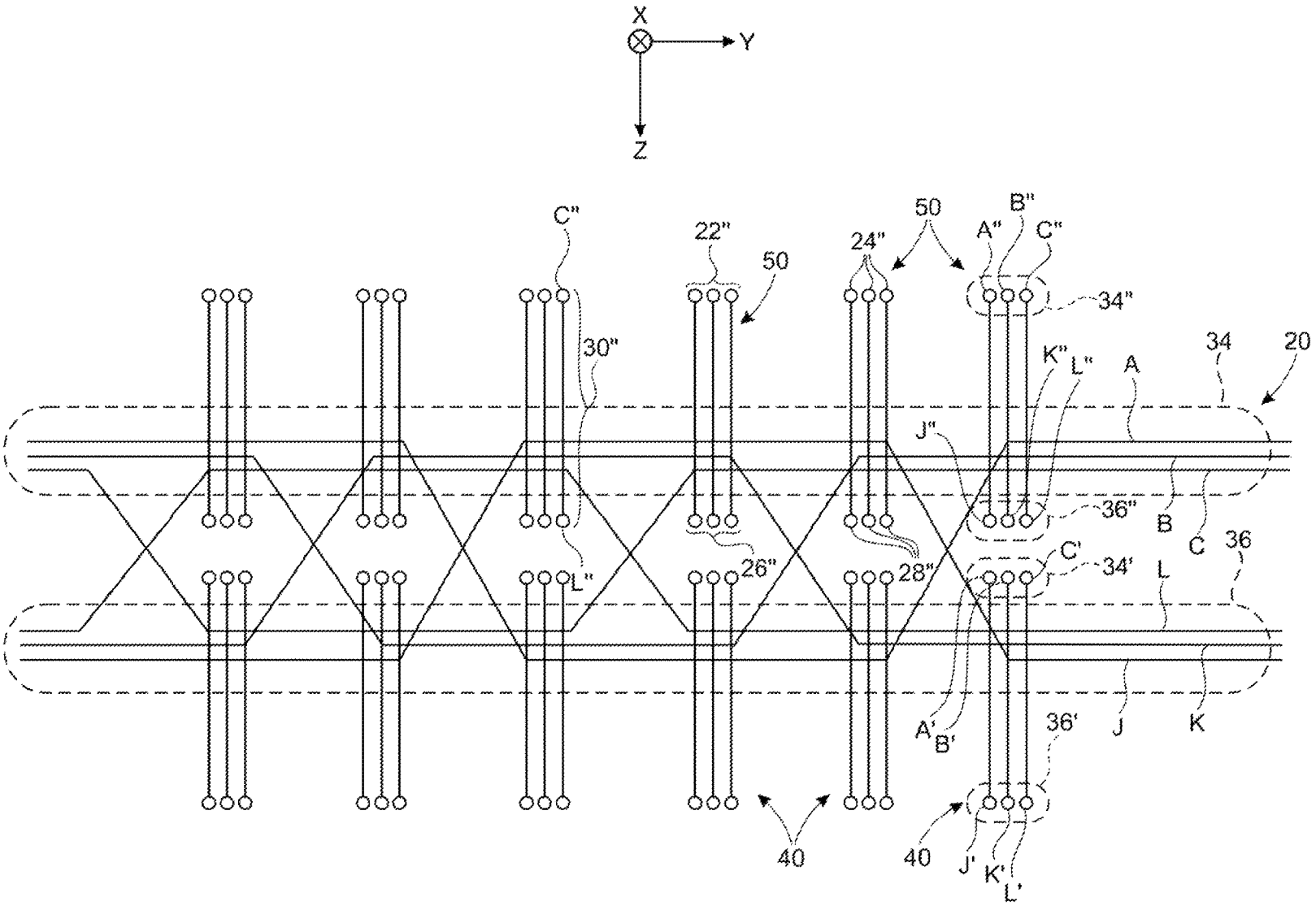
FIG. 5 is a diagrammatical representation of the tow ladder substructure of FIG. 1 with dual transverse tow ladder substructures in the second direction, in accordance with some embodiments.

As shown by a diagrammatic representation in FIG. 5, the plait 20 or tow ladder substructure in a first direction intersects dual transverse plaits, shown as plaits 40 and plaits 50 in the transverse second direction. In the embodiments shown in FIGS. 4-5, the transverse plaits 50 have the same tow ladder substructure as described for plait 20 and plait 40 with respect to FIGS. 2-2C, so that plaits 50 have a group of tows 24" identified in FIGS. 4-5 as tows A", B", and C". Similarly, the transverse plait 50 includes another group of tows 28" identified as tows J", K", and L". As discussed herein, along the plait 50 a portion of the tows in the tow ladder substructure forms an outer subset 34" and the remainder of the tows of the plait forms an inner subset 36". The pairs crossing in the first plait 20 as discussed above with respect to FIG. 1 each cross over a subset of tows of a transverse plait 40 and a subset of tows of a transverse plait 50 as shown diagrammatically in FIGS. 4-5. More specifically, the pairs crossing in the first plait 20 cross over the outer subset of the transverse plait 40 and the inner subset of the transverse plait 50. In similar fashion, additional layers of braid structure can be added to the overall braid structure.

Each plait 50 in the second direction also crosses its pairs at the intersection of transverse plaits 20 in the first direction. As can be seen from FIG. 5, pair crossings of plait 40 will be crossing over the inner subset of the plait 20 while pair crossings of plait 50 will be crossing over the outer subset of the plait 20. In one alternative, the plait angle of the second plait is different than the angle of the third plait.

In the example of FIG. 5, each first plait 20 may include X number of tows in the first group 22 and at least X number of tows in the second group 26, where each of the tows in the first group 22 of tows corresponds to one of the tows in the second group of tows 26 in X number of pairs 30 as discussed above. Similarly, each second plait 40 may include Y number of tows in a third group 22' and at least Y number of tows in a fourth group 26', where each of the tows in the third group 22' of tows corresponds to one of the tows in the fourth group of tows 26' in Y number of pairs 30'. And, each third plait 50 may include Z number of tows in a fifth group 22" and at least Z number of tows in a sixth group 26", where each of the tows in the fifth group 22" of tows corresponds to one of the tows in the sixth group of tows 26" in Z number of pairs 30".

Embodiments of the described braid structure can be used in tubular form, slit during manufacture or in post-processing into lay-flat fabric forms, or may be manufactured in tape form by incorporating turnaround mechanisms into the braiding machine to reverse the direction of travel of tow carriers before the carriers complete a full circumferential transit of the braiding machine.

Alternate embodiments of braid structure may include tows that travel from one tow ladder substructure to another tow ladder substructure lying in the same oblique direction and lying alongside one another. In such embodiments the tow substructures in each oblique direction can be viewed as tow lattices.

The method of making exemplary embodiments has been employed on a machine having a novel general arrangement that is scalable up and down to create braid structures having varying total numbers of tows. The machine is configurable to provide a desired number of tow carriers having an arrangement and construction similar to tow carriers presently used by conventional braiding machines. For example, exemplary embodiments may be manufactured on a machine having 144 tow carriers.

Figure 6:
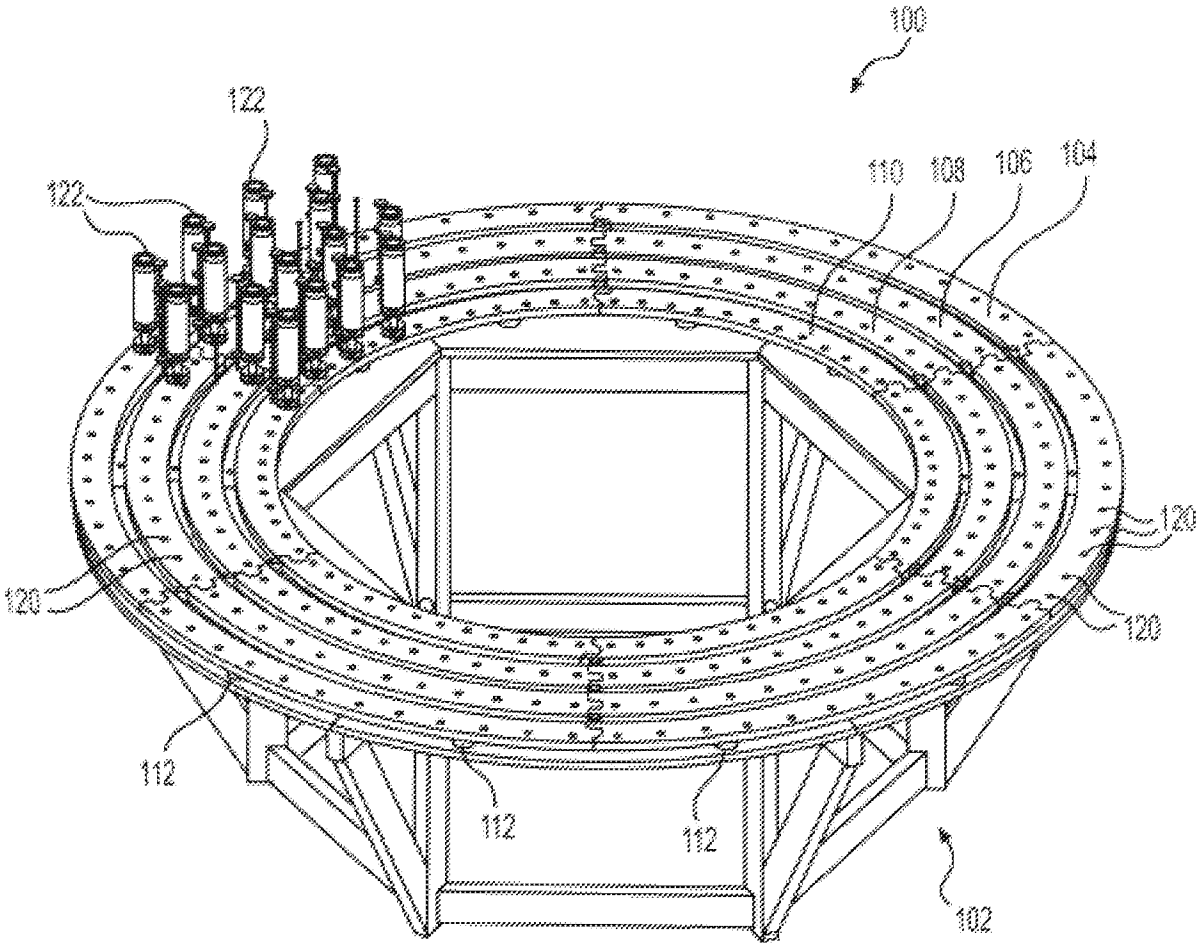
FIG. 6 is a diagrammatical view of an exemplary braiding machine base, in accordance with some embodiments.
Figure 7:
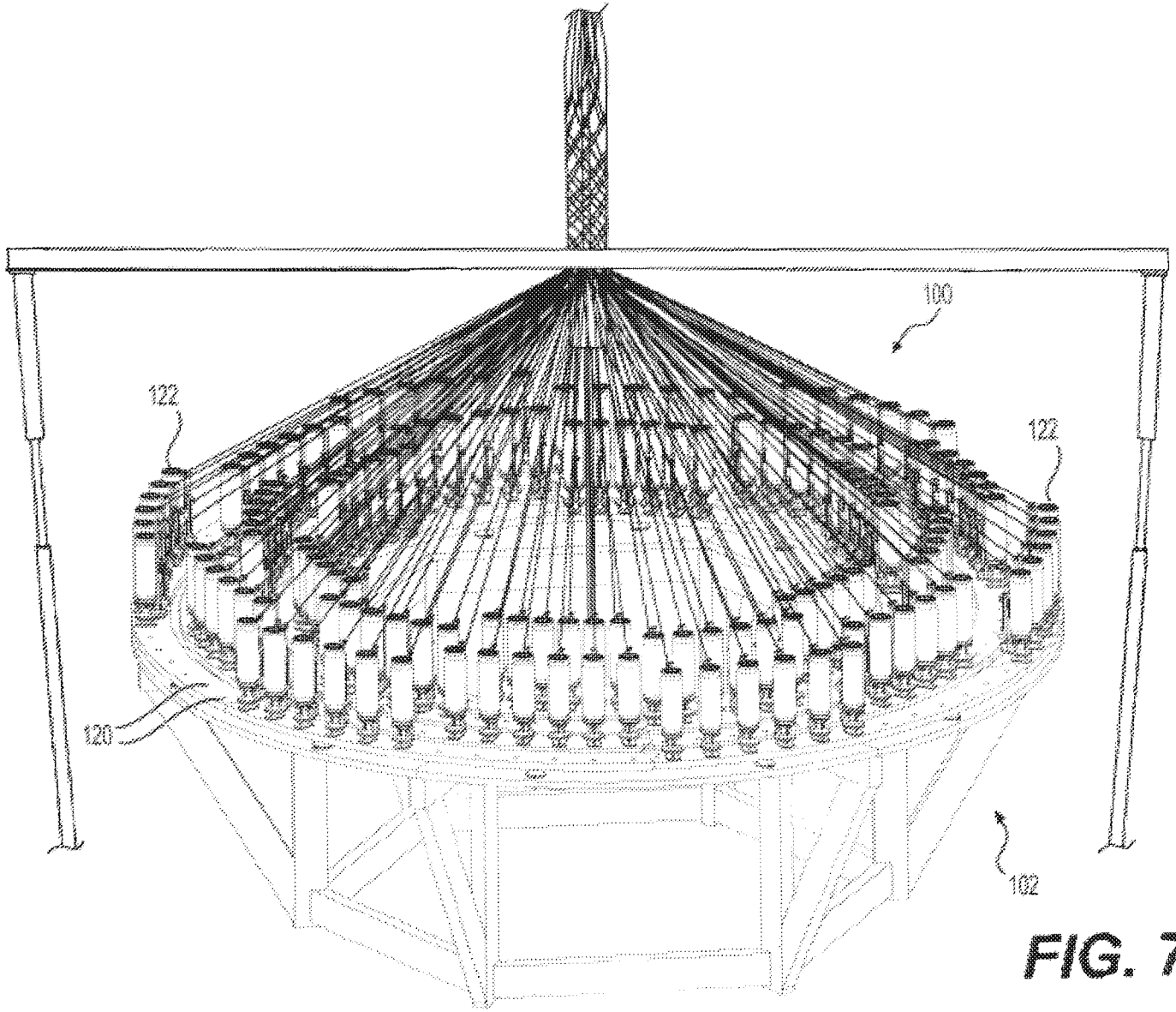
FIG. 7 is a diagrammatical view of the exemplary braiding machine, in accordance with some embodiments

Referring now to FIGS. 6 and 7, some embodiments of a braiding machine 100 include a circular stationary base platform 102 and four concentric carrier rings 104, 106, 108, 110 that lie in a horizontal plane on rollers 112 or bearings affixed to the stationary base platform. The stationary base platform includes guides positioning the rings to maintain ring concentricity. The rings include a plurality of carrier holders 120 to receive and hold conventional tow carriers 122. Additionally, the base may include a plurality of carrier holders positioned to receive and hold tow carriers to feed tows to be provided in the longitudinal direction into the braid as it is formed (not shown). During operation, the braid structure is formed on a mandrel having a longitudinal axis substantially collinear with the vertical axis of the machine and mounted at a height sufficient for initial formation of the braid structure to begin a short distance from the upper end of the mandrel. The machine also includes a mechanism to raise and lower the mandrel relative to the horizontal plane of the carrier rings. The mandrel has a length sufficient for a desired length of braid structure to be formed prior to the braid structure or braid structure and mandrel being removed from the machine.

In the machine, embodiments of which are illustrated in FIGS. 6 and 7, producing the braided structure described by FIGS. 1-3, each tow carrier ring contains 72 carrier holder positions equally spaced around the ring. The position of carrier holders to feed tows to be provided in the longitudinal direction are similarly equally spaced around the circumference of the base.

A method of manufacturing the present three-dimensional braid structure includes the steps of distributing a predetermined number of tow carriers on each ring and, optionally, on the holders for lay-in tows in the longitudinal direction, each carrier positioned according to a manufacturing plan. Then, rotating the rings so that datum positions of the rings lie on the same radial line from the center of the braiding machine, and pulling tows from each carrier and affixing the tows at a point below the upper end of the mandrel, rotating pairs of rings a predetermined angular displacement, moving the tow carriers from ring to ring and advancing the position of the mandrel all according to a predetermined manufacturing plan comprising increments of relative coordinated motion of said components.

The four concentric rings of the present braider are divided into a predetermined number of zones, as illustrated in FIG. 8A-8E, which for the circular rings are wedge-shaped. Within each zone, the ring has a desired number of carriers 122, or may have no carrier depending upon the braid. In an exemplary embodiment, each zone across all of the rings may have the same number of carrier holders. In alternative embodiments, the zones may be sized such that certain zones contain a number of carrier holders different than other zones. In any event, for various braid structures, only a subset of the carrier holders may provide a tow carrier within a zone, or all of the carrier holders may provide a tow carrier, or none of the carrier holders may provide a tow carrier depending upon the braid architecture. In some exemplary embodiments, the rings are paired such that rings 1 and 3 are similarly arranged, and rings 2 and 4 are similarly arranged.

In some exemplary embodiments, for the zones radially adjacent from one ring to the other, one zone is left empty of carriers in one ring while the radially adjacent zone in the next ring contains carriers, and the radially adjacent zone in the following ring is left empty and the radially adjacent zone in the fourth ring contains tow carriers.

Similarly in a circumferential direction around a ring, in some exemplary embodiments, a first zone includes tow carriers and the circumferentially adjacent zone does not, the next circumferentially adjacent zone contains carriers and the next does not. For example, if the braiding rings are each divided into 6 wedge-shaped zones, labeled 1 to 6 around the rings, for one ring zones 1, 3 and 5 may contain carriers, and zones 2, 4 and 6 would not contain carriers for that ring. Similarly, if the braiding rings are each divided into four pieces, for one ring zones 1 and 3 may contain carriers and zones 2 and 4 would not contain carriers for that ring. To provide alternating carriers in radially adjacent zones, this pattern would be the same for rings 1 and 3 (counting from the innermost ring) but the opposite arrangement for rings 2 and 4 in a four zone ring system.

As discussed above, each zone has the same number of carrier holders, each holder being reference numbered from the left, where the like-numbered holders of each ring within a zone are radially aligned. For example, the first holders within a zone are radially aligned, as are the second holders, and so on.

In operation, the rings with the same carrier patterns turn in the same direction, while rings with opposing carrier patterns turn in the opposite direction. For example, rings land 3 turn counterclockwise while rings 2 and 4 turn clockwise.

Figure 8A:
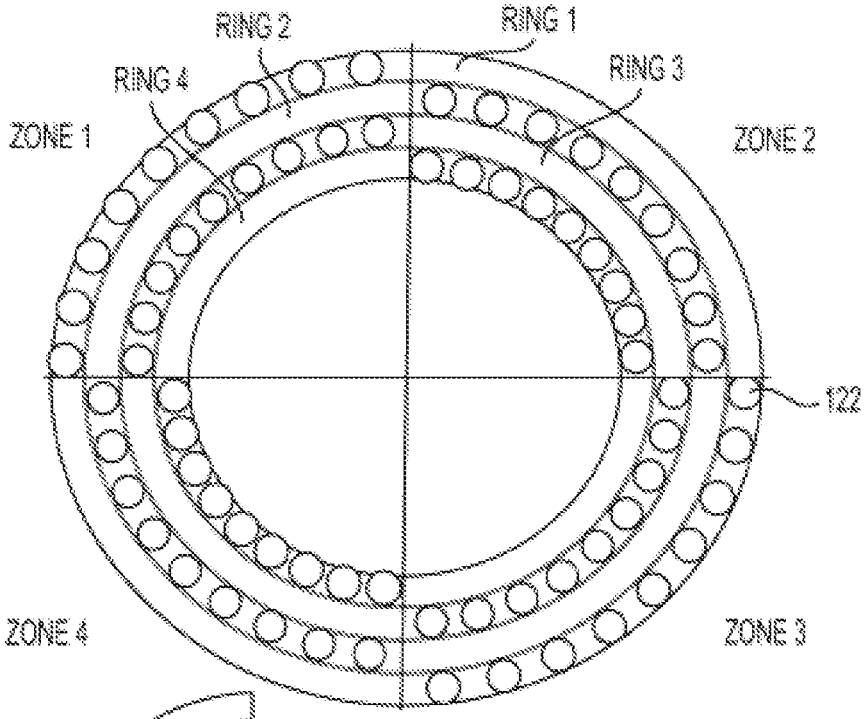
FIG. 8A-8E are schematic views showing a sequence of operation of a braiding machine, in accordance with some embodiments
Figure 8B:
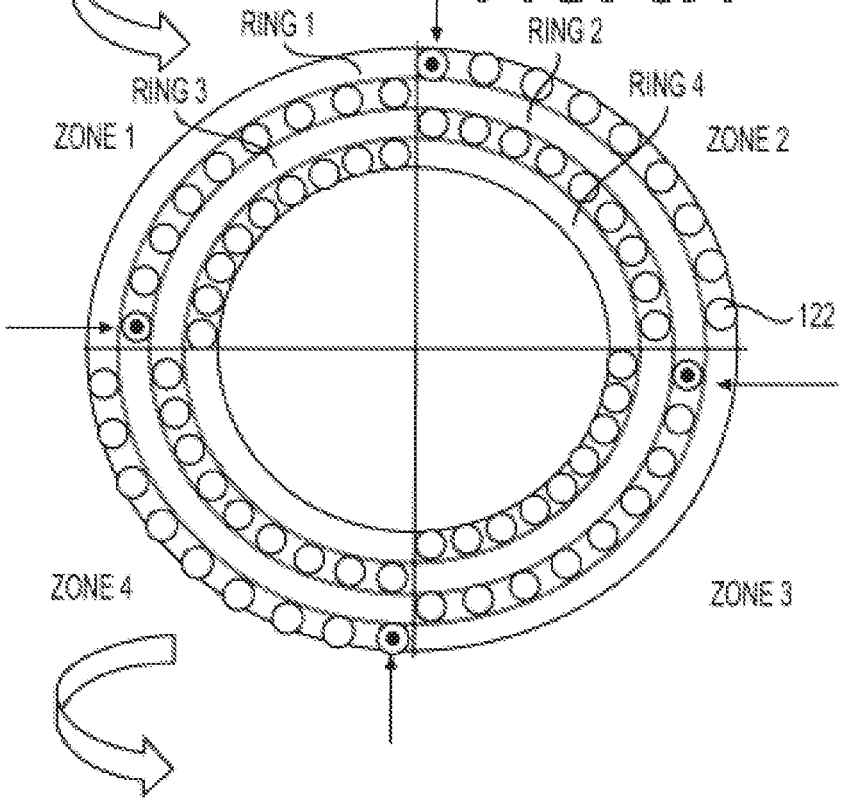
Figure 8C:
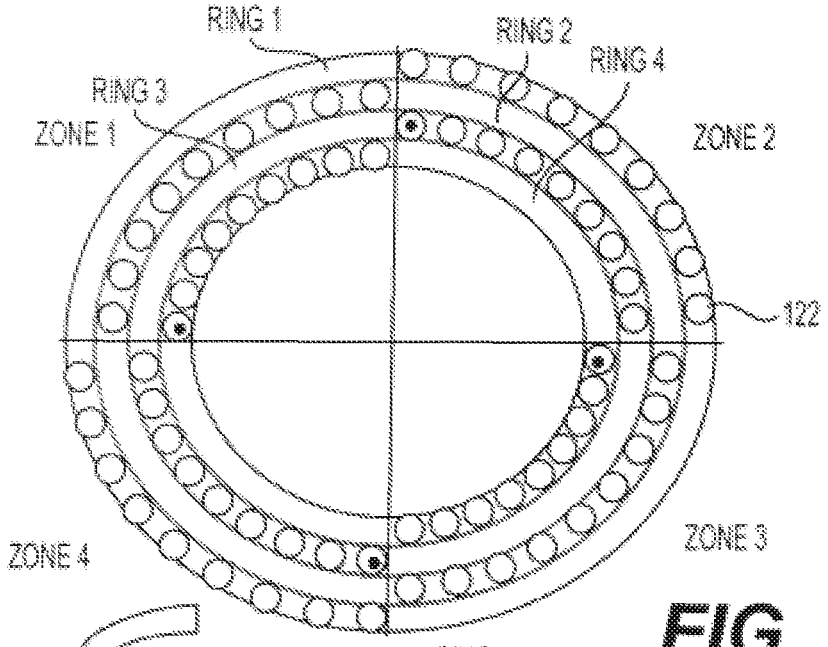

To begin the braiding process, rings 1 and 3, for example, are turned counterclockwise until the carriers 122 advance the rotational distance of one zone. The rotation of the zones as described herein for the braiding machine illustrated in FIG. 8A is illustrated in FIG. 8B. For a 4 zone ring system, the rotational distance of one zone is a 90 degree rotation. For a 6 zone ring system, the rotational distance of one zone is a 60 degree rotation. Simultaneously or sequentially, rings 2 and 4 are rotated clockwise advancing the carriers 122 the rotational distance of one zone. Then, between similarly arranged ring pairs, the carriers 122 in the first holders of each zone (counting from the left) are swapped with each other. The swapping of carriers within FIG. 8B is illustrated in FIG. 8C. Because of the alternating arrangement, in some exemplary embodiments only two rings will have carriers 122 in each zone. For example, in one zone the first carrier 122 in ring 1 is swapped with the first carrier 122 in ring 3 after the rings are rotated, and in adjacent zones, the first carrier 122 of ring 2 is swapped with the first carrier 122 of ring 4.

Figure 8D:
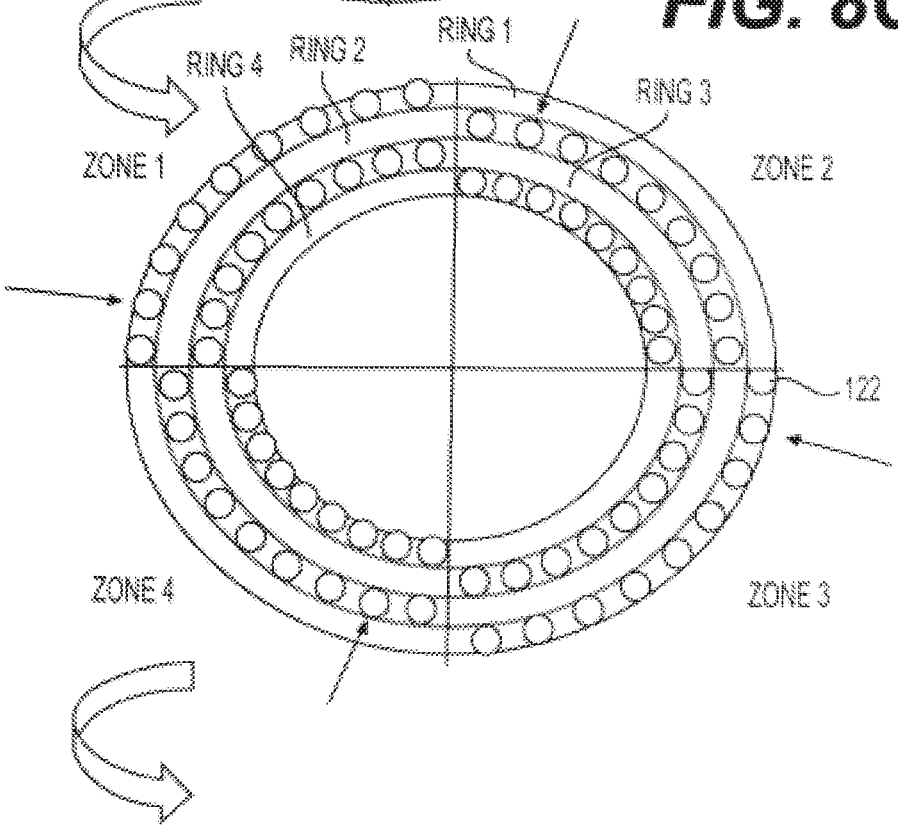
Figure 8E:
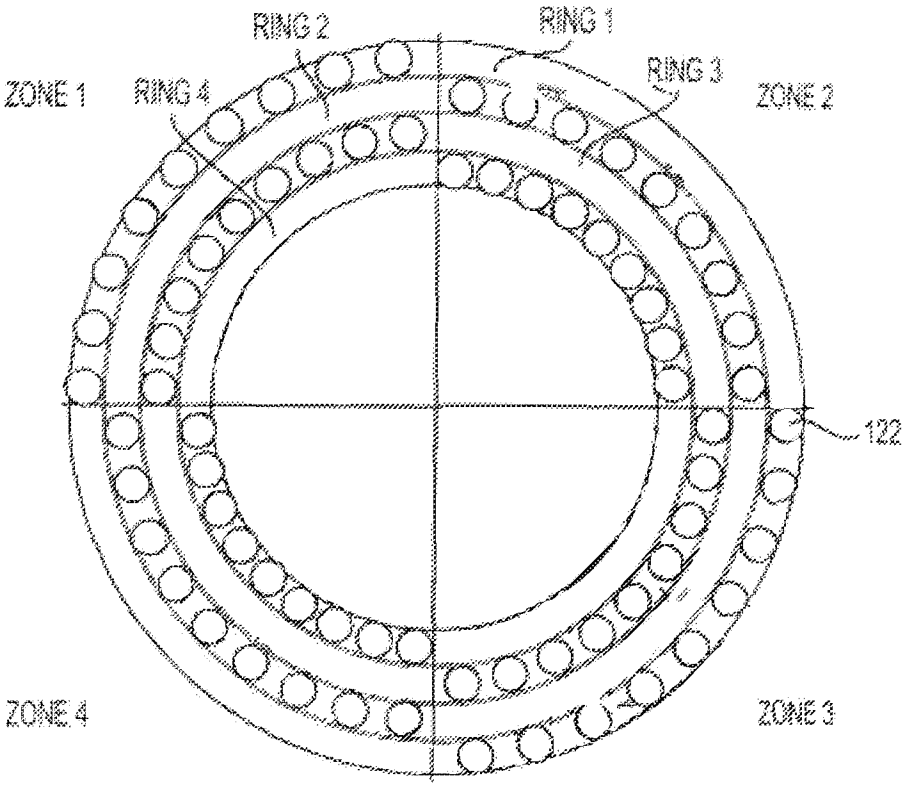

After the first carriers 122 are swapped, the rings continue to rotate in their respective directions the rotational distance of one zone, as illustrated in FIG. 8D, after which the carriers 122, designated by arrows in FIG. 8D, in the second holder positions of each zone are swapped in FIG. 8E. Then, the rings rotate in their respective directions the rotational distance of one zone, after which the carriers 122 in the third holder positions of each zone are swapped. This continues until all of the carrier positions have swapped. After the last carrier 122 position swaps, the rings further advance in their respective directions the rotational distance of one zone, and the carriers 122 in the first holder positions of each zone are swapped to start the sequence over. The sequence repeats continuously forming the desired braid.

During the braiding process, the height of the mandrel may be adjusted so that the braid forming remains at a constant angle throughout the process.

The methods of making the braid may include semi-automated or automated steps.

Embodiments of the three-dimensional braid may be formed on non-circular braiding machines to generate non-tubular braid structures such as T-shaped and TI-shaped braids.

Figure 9:
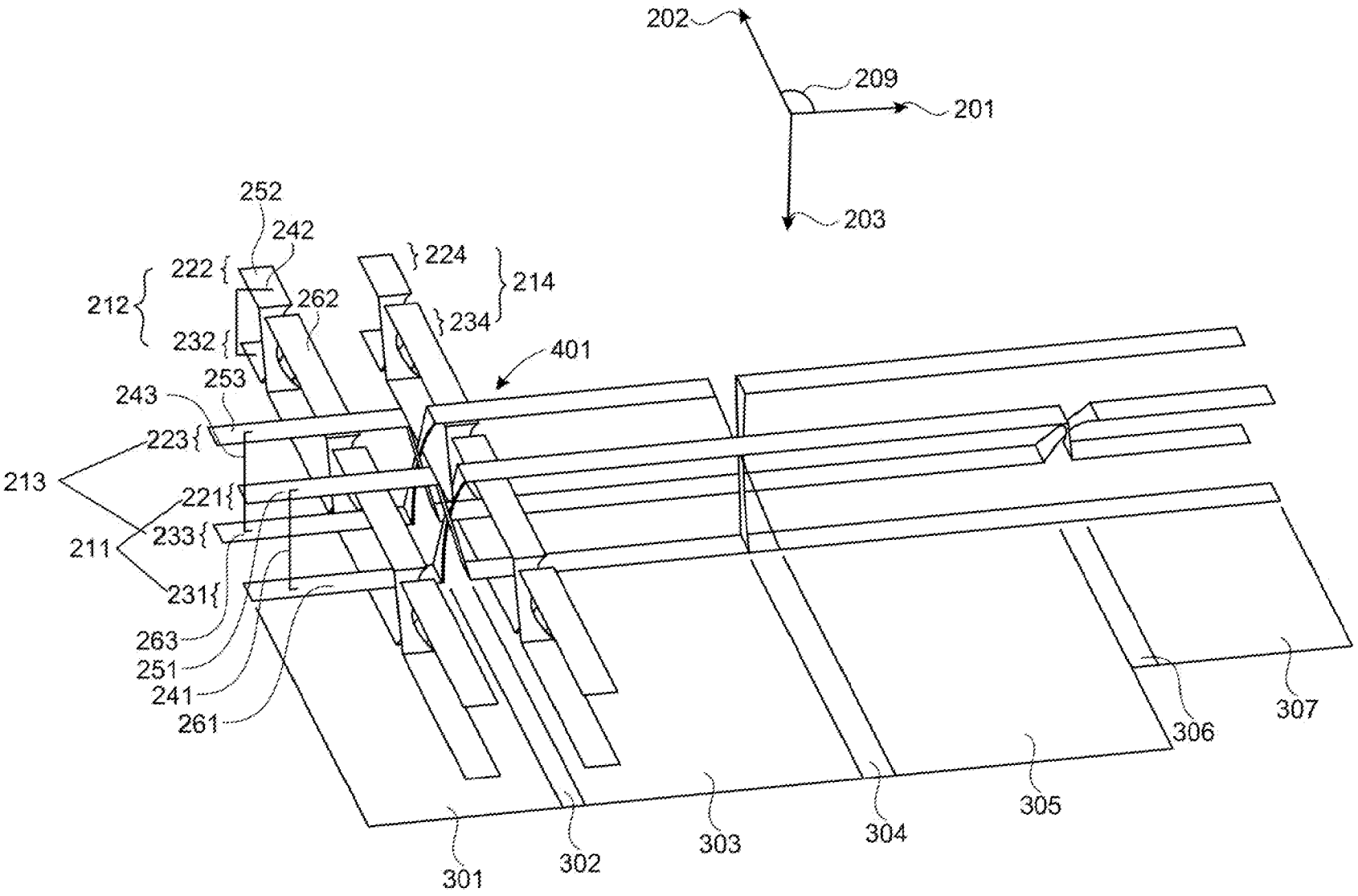
FIG. 9 is a diagrammatical representation of a plurality of tow ladder substructures which illustrates an additional example of the braided structure herein wherein tows comprising tow ladder substructures may be intertwined with tows of other tow ladder substructures, in accordance with some embodiments.

An additional example is a braided fabric, illustrated in FIG. 9, comprising a reference braid direction 201, an oblique direction 202 oriented at an angle 209 with respect to the reference braid direction 201 and a cross-thickness direction 203 substantially perpendicular to the reference braid and oblique directions. FIG. 9 is illustrative of several plaits of a plurality of plaits which may comprise the whole of the braided fabric of examples herein.

The braided fabric may comprise a first plait 211, a second plait 212 and a third plait 213, each having a length and each of the first, second and third plaits including an outer subset of tows, including tows 221, 222 and 223 for plaits 211, 212 and 213 respectively, spaced apart from an inner subset of tows, including tows 231, 232 and 233 for plaits 211, 212 and 213 respectively, along the cross-thickness direction, wherein the first plait 211 is oriented to be parallel with respect to the third plait 213, and the first 211 and third 213 plaits may be oriented along the reference braid direction 201 and the second plait 212 may be oriented along the oblique direction 202.

Each plait 211, 212 and 213 may further include at least one tow pair 241, 242 and 243 for plaits 211, 212 and 213, respectively, comprising a first tow 251, 252 and 253 for plaits 211, 212 and 213, respectively, and a second tow 261, 262 and 263 for plaits 211, 212 and 213, respectively.

The first tows 251 and 253 may be located in the outer subsets 221 and 223, respectively and the second tows 261 and 263 may be located in the inner subsets 231 and 233, respectively, along a first portion 301 of a length of the plaits 211 and 213 in the reference braid direction 201.

The first tows 251 and 253 and the second tows 261 and 263 may be intertwined with each other within their respective plaits 211 and 213 in between the inner subsets 231 and 233 and the outer subsets 221 and 223 along a second portion 302 adjacent to the first portion 301 in the reference braid direction 201 of the length of the plaits 211 and 213.

The first tows 251 and 253 may be located in the inner subsets 231 and 233 of plaits 211 and 213, respectively, and the second tows 261 and 263 may be located in the outer subsets 221 and 223 of plaits 211 and 213, respectively, along a third portion 303 adjacent to the second portion 302 in the reference braid direction 201 of the length of the plaits 211 and 213.

The outer subset 222 of the second plait 212 may be configured to be located in between the inner subset 231 of the first plait 211 and the outer subset 221 of the first plait 211. The outer subset 222 of the second plait 212 may further be configured to be located in between the inner subset 233 of the third plait 213 and the outer subset 223 of the third plait 213, wherein the portion of the first plait 211 within first portion 301 may be located substantially next to an intersection of the outer subset 222 of the second plait 212 with the first plait 211.

The braided fabric may further comprise the first tow 251 of the at least one tow pair 241 of the first plait 211 intertwining with the second tow 263 of the at least one tow pair 243 of the third plait 213 between the inner subsets 231 and 233, respectively, and outer subsets 221 and 223, respectively, of the first plait 211 and the third plait 213 in a fourth portion 304 adjacent to third portion 303 in the reference braid direction of a length of the plaits 211 and 213.

The first tow 251 of the first plait 211 may be located in the outer subset 223 of the third plait 213 and the second tow 263 of the third plait 213 may be located in the inner subset 231 of the first plait 211 in a fifth portion 305 adjacent to fourth portion 304 in the reference braid direction 201 of the a length of the plaits 211 and 213.

The second tow 261 of the at least one tow pair 241 of the first plait 211 may intertwine with the first tow 253 of the at least one tow pair 243 of the third plait 213 between the inner subsets 231 and 233, respectively, and outer subsets 221 and 223, respectively, of the first plait 211 and third plait 213 in a sixth portion 306 adjacent to fifth portion 305 in the reference braid direction 201 of a length of the first plait 211 and the third plait 213.

The second tow 261 of the first plait 211 may be located in the inner subset 233 of the third plait 213 and the first tow 253 of the third plait 213 may be located in the outer subset 221 of the first plait 211 in a seventh portion 307 adjacent to sixth portion 306 in the reference braid direction 201 of a length of the plaits 211 and 213.

The braided fabric may further comprise a fourth plait 214 having a length, the fourth plait 214 including an outer subset 224 of tows spaced apart from an inner subset 234 of tows along the cross-thickness direction 203, wherein the fourth plait may be oriented to be parallel with respect to the second plait 212 along its respective length.

The outer subset 224 of the fourth plait 214 may be configured to be located in between the inner subset 231 of the first plait 211 and the outer subset 221 of the first plait 211, the outer subset 224 of the fourth plait 214 may further be configured to be located in between the inner subset 233 of the third plait 213 and the outer subset 223 of the third plait 213, wherein the portion of the first plait 211 within fourth portion 304 may be located substantially next to an intersection of the outer subset 224 of the fourth plait 214 with the first plait 211.

An additional example is a braided fabric having a length along a reference braid direction 201, an oblique direction 202 oriented at an angle 209 with respect to the reference direction 201 and a cross-thickness direction 203 substantially perpendicular to the reference braid and oblique directions.

The braided fabric may comprise a plurality of plaits including at least one set of plaits, each of the plurality of plaits including at least a plurality of tows configured to cross with each other in the cross-thickness direction 203, wherein a first plait 211 of the at least one set of plaits is configured to be oriented along its length at an angle with respect to at least one of second plait 212 of the at least one set of plaits or a third plait 213 of the at least one set of plaits along the length of the first plait 211.

The first plait 211 may be configured to be at least partially layered over the second plait 212 at a first location 401 along the cross-thickness direction 203, wherein at least a first tow of the plurality of tows of the first plait 211 may cross with a second tow of the plurality of tows adjacent to the first location 401. The third plait 213 may be configured to be at least partially layered over the second plait 212 substantially at the first location 401.

Each of the plurality of plaits may comprise a cross-thickness width, and the first location 401 of a partial layer of the first plait 211 and the third plait 213 over the second plait 212 may be at substantially half the cross-thickness width of at least one of the first plait 211 and the third plait 213.

The first plait 211 may be configured to be oriented above the third plait 213, such that the second plait 212 may be configured to be at least partially layered between the first plait 211 and the third plait 213.

The first plait 211 and third plait 213 may be configured to be oriented substantially parallel to one another oriented in a first direction having a positive angle from a reference braid direction. In some cases, a plurality of second plaits are adjacent one another oriented in a second direction transverse to the first direction having a negative angle from the reference braid direction, the plurality of first plaits intertwined with the plurality of second plaits forming a braid; each of the plurality of first plaits comprising a plurality of first plait tows, the first plait tows may further include a first group of tows having a first number of tows; a second group of tows having the first number of tows; and a plurality of pairs of first plait tows, wherein each of the tows in the first group of tows corresponds to one of the tows in the second group of tows; each of the plurality of second plaits comprising a plurality of second plait tows, the second plait tows may include a third group of tows having a second number of tows; a fourth group of tows having the second number of tows; and a plurality of pairs of second plait tows, wherein each of the tows in the third group of tows corresponds to one of the tows in the fourth group of tows; wherein each first plait intersecting each of the plurality of second plaits in succession; and for each first plait, one of the plurality of pairs of first plait tows configured to cross over at least one of the second number of tows at each intersection of the first plait and one of the plurality of second plaits in succession, thereby forming a series of a plurality of braid points along the first plait.

In some embodiments, the braided material includes each tow of the plurality of first plait tows and the plurality of second plait tows may include a first portion of the tow configured to form an outer subset of its respective plait, and a second portion of the tow configured to form an inner subset of its respective plait. The material includes at a first location along a length of the braided material, one tow of one pair of the plurality of pairs of first plait tows is oriented in the first portion and the other tow of the one pair is oriented in the second portion. The material includes at a second location along a length of the braided material, the second location being next to one of the intersections of the first plait and one of the plurality of second plaits in succession, in which the one tow of the one pair crosses with the other tow of the one pair, the one tow is oriented in the second portion and the other tow of the one pair is oriented in the first portion.

According to some embodiments, a braided material includes a plurality of first plaits adjacent one another system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. The braided sleeve may also includes a central axis along a length of the braided sleeve. The sleeve also includes a plurality of first plaits and a plurality of second plaits positioned around the central axis in a radial direction with respect to the central axis, each plait of the plurality of first plaits and the plurality of second plaits including an outer subset of tows and an inner subset of tows extending along a respective length of the plait, each plait including the outer subset and the inner subset being substantially parallel to each other and spaced apart from each other with respect to the radial direction, and each plait including at least one tow pair may include a first tow and a second tow that are intertwined with each other in between the inner subset and the outer subset. The sleeve also includes where the inner subset and the outer subset of at least some of the plurality of second plaits are oriented at a transverse angle with respect to the inner subset and the outer subset of at least some of the plurality of first plaits, and the outer subset of the at least some of the plurality of second plaits is positioned in between the inner subset and the outer subset of a first plait of the plurality of first plaits, and where the first tow and the second tow of a first tow pair of the first plait are intertwined adjacent to the outer subset of a corresponding one of the plurality of second plaits. Other embodiments of this aspect include corresponding computer systems, apparatus, and computer programs recorded on one or more computer storage devices, each configured to perform the actions of the methods.

Implementations may include one or more of the following features. The braided sleeve may include: the first plait further including a second tow pair, the second tow pair including a third tow and a fourth tow that are intertwined with each other in between the inner subset and the outer subset of the first plait; and the third tow and the fourth tow are intertwined next to the outer subset of a corresponding second one of the plurality of second plaits, where the corresponding one of the plurality of second plaits and the corresponding second one of the plurality of second plaits are adjacent to each other. The braided sleeve may include: at a location, along the length of the first plait, that the first tow and the second tow are intertwined, the third tow and the fourth tow are spaced apart from each other with respect to the radial direction. The braided sleeve may include: at a location, along the length of the first plait, that the third and the fourth tow are intertwined, the first tow and the second tow are spaced apart from each other with respect to the radial direction. The braided sleeve may include: a repeating braid pattern along the length of the braided sleeve including the first tow and the second tow of the first tow pair of the first plait intertwining adjacent to the corresponding one of the plurality of second plaits, and the third tow and the fourth tow of the second tow pair of the first plait intertwining adjacent to the corresponding second one of the plurality of second plaits, the corresponding one of the plurality of second plaits located in succession adjacent to the corresponding second one of the plurality of second plaits. The fifth tow and the sixth tow are intertwined next to the inner subset of a corresponding one of the plurality of first plaits. The corresponding one of the plurality of first plaits and the corresponding second one of the plurality of first plaits are adjacent to each other. A braid reinforced composite including the braided sleeve. Implementations of the described techniques may include hardware, a method or process, or computer software on a computer-accessible medium.

One general aspect includes a braided fabric having a reference braid direction and a cross thickness direction substantially perpendicular to the reference braid direction. The braided fabric also includes a first plait and a second plait each having a length, each of the first plait and the second plait including an outer subset of tows spaced apart from an inner subset of tows along the cross thickness direction, where the first plait, along a length of the first plait, is oriented at an angle with respect to the second plait along its length, and each plait further including at least one tow pair may include a first tow and a second tow, where the fabric also includes the first tow being located in the outer subset and the second tow being located in the inner subset along a first portion of a length of the respective plait. The fabric also includes the first tow and the second tow being intertwined with each other in between the inner subset and the outer subset along a second portion of the length of the respective plait. The fabric also includes the first tow being located in the inner subset and the second tow being located in the outer subset along a third portion of the length of the respective plait. The fabric also includes the outer subset of the second plait configured to be located in between the inner subset of the first plait and the outer subset of the first plait, and where the second portion of the first plait is located substantially next to an intersection of the outer subset of the second plait with the first plait. Other embodiments of this aspect include corresponding computer systems, apparatus, and computer programs recorded on one or more computer storage devices, each configured to perform the actions of the methods.

Implementations may include one or more of the following features. The braided fabric may include: each plait further including at least two tow pairs, the at least two tow pairs including a third tow and a fourth tow that are intertwined with each other in between the inner subset and the outer subset of the respective plait, where; the third tow being located in the outer subset and the fourth tow being located in the inner subset along a fourth portion of a length of the respective plait; the third tow and the fourth tow being intertwined with each other in between the inner subset and the outer subset along a fifth portion of the length of the respective plait; and the third tow being located in the inner subset and the fourth tow being located in the outer subset along a sixth portion of the length of the respective plait; and a third plait having a length, the third plait including an outer subset of tows spaced apart from an inner subset of tows along the cross thickness direction, where the third plait along its length is oriented to be parallel and adjacent to the second plait along its respective length; and the outer subset of the third plait configured to be located in between the inner subset of the first plait and the outer subset of the first plait, and where the fifth portion of the first plait is located substantially next to an intersection of the outer subset of the third plait with the first plait. The fourth plait along its length is oriented to be parallel and adjacent to the first plait along its respective length; and the outer subset of the third plait configured to be located in between the inner subset of the first plait and the outer subset of the first plait, and where the fifth portion of the second plait is located substantially next to an intersection of the inner subset of the third plait with the second plait. The braided fabric may include at the second portion of the first plait, the third tow and the fourth tow are configured to be in one of the fourth portion or the sixth portion of the first plait. The braided fabric may include at the fifth portion of the first plait, the first tow and the second tow are configured to be in one of the first portion of the third portion of the first plait. A braid reinforced composite including the braided fabric. Implementations of the described techniques may include hardware, a method or process, or computer software on a computer-accessible medium.

One general aspect includes a braided fabric having a length along a reference braid direction and a cross thickness direction substantially perpendicular to the reference braid direction. The braided fabric also includes a plurality of plaits including at least one set of plaits, each of the plurality of plaits including at least a plurality of tows configured to cross with each other in the cross-thickness direction, and where a first plait of the at least one set of plaits configured to be oriented along its length at an angle with respect to a second plait of the at least one set of plaits along its length. The fabric also includes the first plait configured to be at least partially layered over the second plait at a first location along the cross-thickness direction, where at least first tow of the plurality of tows of the first plait crosses with a second tow of the plurality of tows adjacent to the first location. Other embodiments of this aspect include corresponding computer systems, apparatus, and computer programs recorded on one or more computer storage devices, each configured to perform the actions of the methods.

Implementations may include one or more of the following features. The braided fabric may include each of the plurality of plaits having a cross thickness width, and the first location of the partial layering of the first plait over the second plait is at substantially half of the cross thickness width of the first plait. Each tow of the plurality of tows of the second plait crosses with each other adjacent to the second location. Each tow of the plurality of tows of the first plait crosses with each other adjacent to the third location. Each tow of the plurality of tows of the fourth plait crosses with each other adjacent to the fourth location; and the fourth plait further configured to be at least partially layered over the third plait at a fifth location along the cross thickness direction of the fourth plait, where each tow of the plurality of tows of the fourth plait crosses with each other adjacent to the fifth location and where the fourth location and the fifth location are at substantially half of the cross thickness width of the fourth plait. A braid reinforced composite including the braided fabric. The braided material further. The braided material includes each tow of the plurality of first plait tows and the plurality of second plait tows may include a first portion of the tow configured to form an outer subset of its respective plait, and a second portion of the tow configured to form an inner subset of its respective plait. The material includes at a first location along a length of the braided material, one tow of one pair of the plurality of pairs of first plait tows is oriented in the first portion and the other tow of the one pair is oriented in the second portion. The material includes at a second location along a length of the braided material, the second location being next to one of the intersections of the first plait and one of the plurality of second plaits in succession, in which the one tow of the one pair crosses with the other tow of the one pair, the one tow is oriented in the second portion and the other tow of the one pair is oriented in the first portion. Implementations of the described techniques may include hardware, a method or process, or computer software on a computer-accessible medium.

Implementations may include one or more of the following features. The braided material further. The braided material includes each tow of the plurality of first plait tows and the plurality of second plait tows may include a first portion of the tow configured to form an outer subset of its respective plait, and a second portion of the tow configured to form an inner subset of its respective plait. The material includes at a first location along a length of the braided material, one tow of one pair of the plurality of pairs of first plait tows is oriented in the first portion and the other tow of the one pair is oriented in the second portion. The material includes at a second location along a length of the braided material, the second location being next to one of the intersections of the first plait and one of the plurality of second plaits in succession, in which the one tow of the one pair crosses with the other tow of the one pair, the one tow is oriented in the second portion and the other tow of the one pair is oriented in the first portion. Implementations of the described techniques may include hardware, a method or process, or computer software on a computer-accessible medium.

While embodiments of the invention have been illustrated and described in detail in the drawings and foregoing description, the same is to be considered as illustrative and not restrictive in character, it being understood that exemplary embodiments have been shown and described and that all changes and modifications that come within the spirit of the invention are desired to be protected by the appended claims and the equivalents thereof.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and shall have the same meaning as the word "comprising.

As used herein, the term "or" is used inclusively to refer items in the alternative and in combination.

As used herein, characters such as numerals refer to like elements.

Embodiments of the present disclosure have been shown and described as set forth herein and are provided by way of example only. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

What is claimed is:

1. A braided fabric having a length along a braid direction and a cross-thickness direction substantially perpendicular to the braid direction, the braided fabric comprising;

a plurality of plaits including at least one set of plaits, each of the plurality of plaits including at least a plurality of tows configured to cross with each other in the cross-thickness direction, and wherein a first plait of the at least one set of plaits is configured to be oriented along its length at an angle with respect to at least one of a second plait of the at least one set of plaits or a third plait of the at least one set of plaits along the length of the first plait.

2. The braided fabric of claim 1, further comprising the first plait configured to be at least partially layered over the second plait at a first location along the cross-thickness direction, wherein at least a first tow of the plurality of tows of the first plait crosses with a second tow of the plurality of tows adjacent to the first location; and the third plait configured to be at least partially layered over the second plait substantially at the first location.

3. The braided fabric of claim 2 wherein each of the plurality of plaits having a cross-thickness width, and the first location of a partial layer of the first plait and the third plait over the second plait is at substantially half the cross-thickness width of at least one of the first plait and the third plait.

4. The braided fabric of claim 3 wherein the first plait and third plait are configured to be oriented substantially parallel to one another.

5. The braided fabric of claim 1 further comprising the first plait configured to be oriented above the third plait, such that the second plait is at least partially layered between the first plait and the third plait.

* * * * *